US006164931A

United States Patent [19]

Norton et al.

[11] Patent Number: 6,164,931

[45] Date of Patent: Dec. 26, 2000

[54] COMPRESSOR WHEEL ASSEMBLY FOR TURBOCHARGERS

[75] Inventors: Richard F. Norton, Edwards; James C. Smith, Washington, both of Ill.

[73] Assignee: Caterpillar Inc., Peoria, Ill.

[21] Appl. No.: 09/461,314

[22] Filed: Dec. 15, 1999

[51] Int. Cl.[7] ..... F04B 17/05

[52] U.S. Cl. ..... 417/407; 415/241 R; 415/244 R; 29/889.2

[58] Field of Search ..... 417/407; 415/241 R, 415/244 R, 244 A; 29/889.2

[56] References Cited

U.S. PATENT DOCUMENTS

| | | | |
|---|---|---|---|
| 4,643,641 | 2/1987 | Clausen et al. | 415/174.3 |
| 4,705,463 | 11/1987 | Joco | 417/407 |
| 4,986,733 | 1/1991 | Fleury et al. | 415/230 |
| 5,090,870 | 2/1992 | Gilliam | 416/241 R |
| 5,176,497 | 1/1993 | Deacon et al. | 415/230 |
| 5,193,989 | 3/1993 | Fleury et al. | 417/407 |
| 5,897,407 | 4/1999 | Mendelson et al. | 440/49 |

*Primary Examiner*—Timothy S. Thorpe
*Assistant Examiner*—Robert Z. Evora
*Attorney, Agent, or Firm*—Keith P. Roberson

[57] ABSTRACT

Turbochargers experience tensile loads due their high rotational speeds. These tensile loads tend to expand surface defects present about a bore portion of a compressor wheel. Expansion of these surface defects may ultimately result in failure of the compressor wheel. Removing these surface defects or imparting residual compressive stresses on the bore portion reduces failure of the compressor wheel caused by tensile loading.

7 Claims, 3 Drawing Sheets

COMPRESSOR WHEEL ASSEMBLY FOR TURBOCHARGERS

TECHNICAL FIELD

This invention relates generally to a turbocharger for an internal combustion engine and more specifically to a centrifugal compressor wheel or impeller having improved resistance to failure.

BACKGROUND ART

The use of turbochargers to increase the air intake of internal combustion engines is known to increase engine output. In many conventional turbochargers a compressor wheel is driven at high speeds or revolutions per minute. For example, many compressor wheels rotate in the range of about 100,000 to 150,000 revolutions per minute.

To further accommodate these high speeds, many manufacturers fabricate compressor wheels using lightweight materials such as aluminum and aluminum alloys. The lighter weight materials allow the compressor wheels to have lower rotational inertia. These compressor wheels respond more rapidly to transient conditions of the internal combustion engine. Furthermore, manufacturers typically cast compressor wheels to maintain low cost and reproducibility of complex structures of the compressor wheel.

However, the high speeds have reduced compressor wheel life. Many compressor wheels are attached to a turbine wheel by a shaft. The shaft passes through a bore in the hub of the compressor wheel. A nut or threaded shaft holds the shaft in contact with the hub of the compressor wheel. At higher rotational speeds, centripetal acceleration of the compressor wheel mass creates high tensile loading of the compressor wheel near the bore. This loading is especially severe during transient conditions of the internal combustion engine. The casting process of the compressor wheel creates additional areas for imperfections such as dross, voids, and inclusions where fatigue failure may occur.

In U.S. Pat. No. 4,705,463, issued to Fidel M. Joco on Nov. 10, 1986 the bore of the compressor wheel is nearly eliminated. Instead, the shaft threads into a counter bore. Using the counter bore reduces the stress risers present due to the bore and process of casting such bore. The compressor wheel of this invention has a longer life. However, alignment of the shaft with the wheel, assembly, and servicing of compressors using this invention may be more difficult and expensive.

The present invention is directed to overcoming one or more of the problems as set forth above.

DISCLOSURE OF THE INVENTION

In one aspect of the present invention a turbocharger has a turbine wheel connected to a shaft. A compressor wheel also connected to the shaft has a first end portion, a second end portion, and a hub portion. The first end portion is distal from the second end portion. The hub portion extends between the first end portion and the second end portion. The hub portion has an inner circumference defining a bore. The inner circumference is surface treated to reduce surface defects.

BEST MODE FOR CARRYING OUT THE INVENTION

Figure 1:
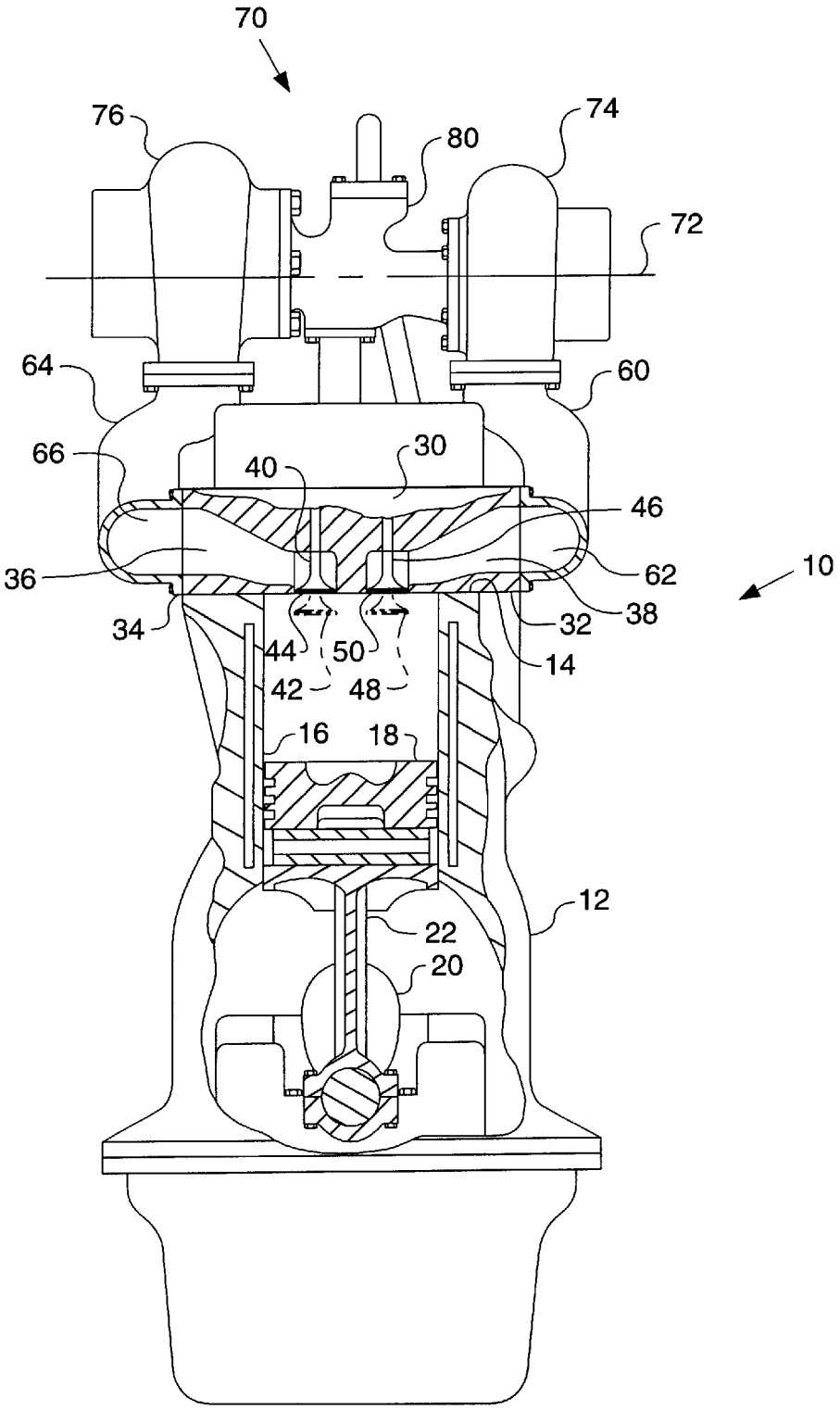
FIG. 1 is a partially sectioned end view of an engine disclosing a turbocharger including an embodiment of the present invention.

Referring to FIG. 1, an internal combustion engine 10 includes a block 12 having a top surface 14 defined thereon and a cylinder bore 16 extending from the top surface 14 and generally through the block 12. A piston 18 slidably positions in the bore 16 of the block 12 in a conventional manner. A crankshaft 20 rotatably positions in the block 12 and has a connecting rod 22 attaching between the crankshaft 20 and the piston 18.

A bottom surface 32 of a cylinder head 30 attaches to the block 12 in a conventional manner. A gasket 34 of conventional construction interposes the bottom surface 32 and the top surface 14 of the block 12. The cylinder head 30 has a plurality of intake passages 36, only one shown, and a plurality of exhaust passages 38, only one shown, defined therein. An intake valve 40 is disposed in each of the plurality of intake passages 36. The intake valve 40 has an open position 42, shown in phantom, and a closed position 44. In the open position 42, the bore 16 communicates with the intake passage 36. In the closed position 44, the intake valve 40 prevents communication between the bore 16 and the intake passage 36. An exhaust valve 46 is disposed in each of the plurality of exhaust passages 38. The exhaust valve has an open position 48, shown in phantom, and a closed position 50. In the open position 48, the bore 16 communicates with the exhaust passage 38. In the closed position 50, the exhaust valve prevents communication between the bore 16 and the exhaust passage 38.

An exhaust manifold 60 attaches to the cylinder head 30 in a conventional manner. The exhaust manifold 60 has a passage 62 defined therein being in communication with the exhaust passage 38 in the cylinder head 30. An intake manifold 64 attaches to the cylinder head 30 in a conventional manner. The intake manifold has a passage 66 defined therein which communicates with the intake passage 36.

Figure 2:
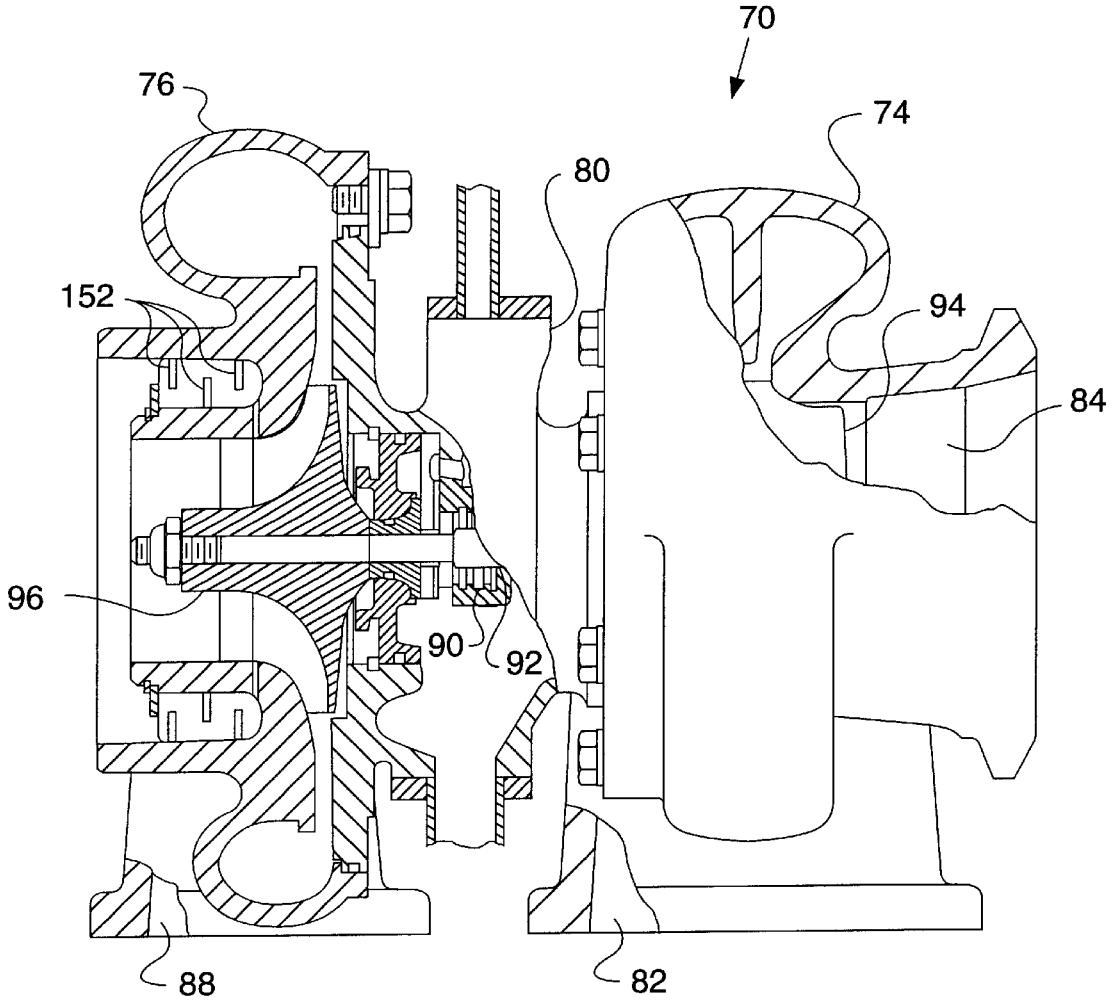
FIG. 2 is an enlarged partially sectioned view of the turbocharger of FIG. 1.

A turbocharger 70, as best shown in FIGS. 1 and 2, attaches to the engine 10 in a conventional manner. The turbocharger 70 includes an axis 72, an exhaust housing 74, an intake housing 76, and a bearing housing 80 interposed the exhaust housing 74 and the intake housing 76.

The exhaust housing 74 has an inlet opening 82 and an exhaust opening 84 defined therein. The exhaust housing 74 is positioned at one end of the turbocharger 70 and removably attaches to the exhaust manifold 60 in such a position so that the inlet opening 82 communicates with the passage 62 in the exhaust manifold 60.

The intake housing 76 has an intake opening 86 and an outlet opening 88 defined therein. The intake housing 76 is positioned at another end of the turbocharger 70 and removably attaches to the intake manifold 64 in such a position so that the outlet opening 88 communicates with the passage 66 in the intake manifold 64.

The bearing housing 80 has a plurality of bearings 90, only one shown, positioned therein in a conventional manner. The plurality of bearings 90 are lubricated and cooled in a conventional manner. A shaft 92 is positioned coaxial with the axis 72 and rotatably within the plurality of bearings 90. In this application a turbine wheel 94 attaches at one end, and a compressor wheel 96 attaches at the other end of the shaft 92. However, the compressor wheel 96 may be driven by any conventional manner such as a belt. The turbine wheel 94 is positioned within the exhaust housing 74 and the compressor wheel 96 is positioned within the intake housing 76.

Figure 3:
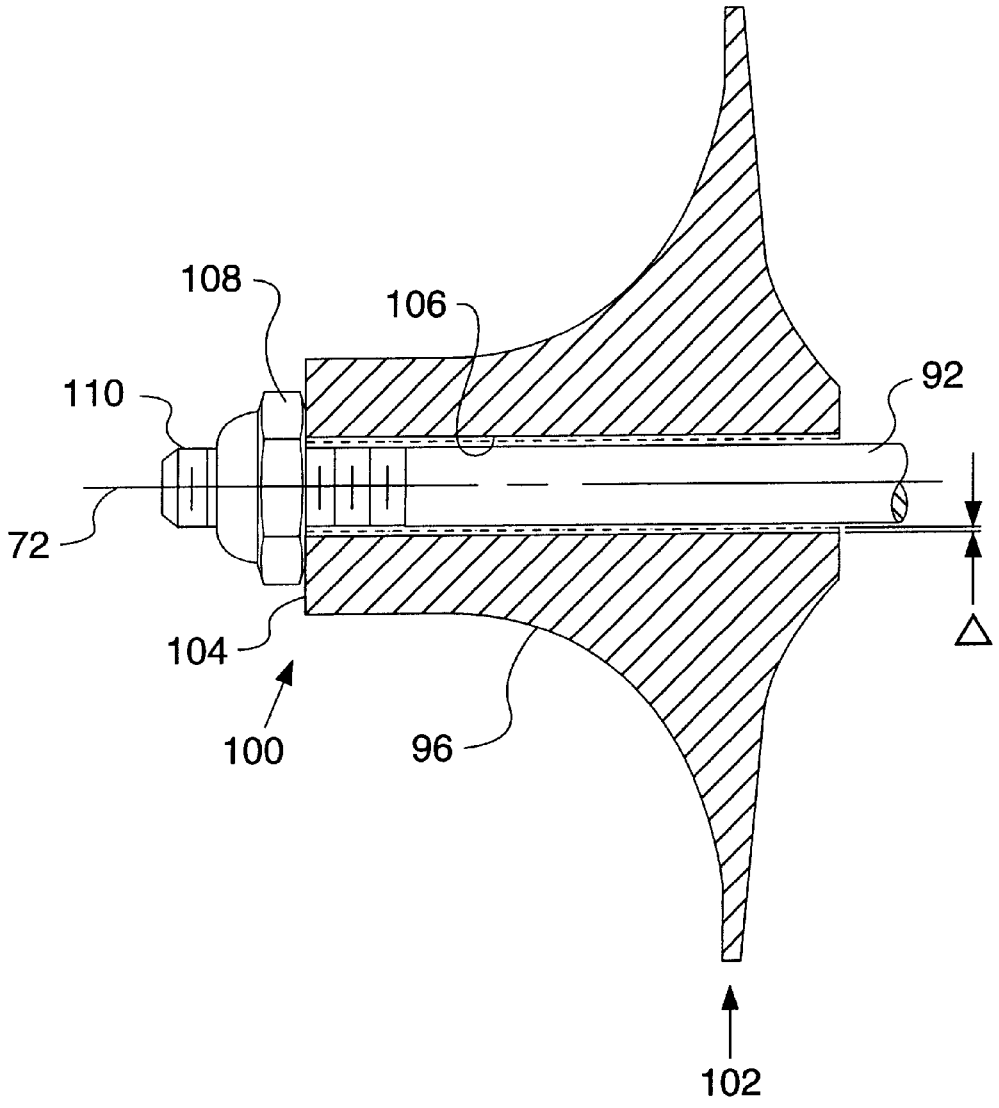
FIG. 3 is an enlarged view of a compressor wheel shown in FIG. 2.

As shown in FIG. 3, the compressor wheel 96 is generally cast using a durable, heat resistant material such as aluminum, steel, titanium or related alloys. The compressor wheel has a first end portion 100 distal from said turbine wheel 94 and a second end portion 102 distal from said first end 100 towards the turbine wheel 94. A hub portion 104 of the compressor wheel 96 forms about the axis 72. An inner circumference 106 of the hub portion 104 defines a bore that extends between said first end portion 100 and said second end portion 102. The inner circumference 106 is generally coaxial with the axis 72. The inner circumference 106 is sized such that the shaft 92 may pass through the bore. In this invention, the inner circumference 106 is cold worked in a conventional manner such as roller expanding, shot peening, or ballizing.

The shaft 92 passes through the compressor wheel 96 along the inner circumference 106. Some conventional manner attaches the shaft 92 to the compressor wheel 96. FIG. 3 shows one method of attachment whereby a nut 110 attaches to a threaded portion 110 of the shaft 92. The nut 108 abuts with the hub 104.

Industrial Applicability

In use, the engine 10 is started and the rotation of the crankshaft 20 causes the piston 18 to reciprocate. As the piston 18 moves into the intake stroke, the pressure within the bore 16 is lower than atmospheric. Furthermore, rotation of the compressor wheel 96 draws air from the atmosphere increasing the density of the air. The air is then typically cooled to further increase the density. In general, the air then passes through the intake passage 36, around the intake valve 40 in the open position 42 and enters the bore 16. Fuel is added in a conventional manner and the engine 10 starts and operates. As the engine 10 is operating, after combustion has occurred, the exhaust gasses pass around the exhaust valve 46 in the open position 48, into the passage 62 in the exhaust manifold 60 and enter the exhaust housing 74 of the turbocharger 70. The energy in the exhaust gasses drives the turbine wheel 94 rotating the shaft 92 and the compressor wheel 96 to increase the density and volume of incoming combustion air to the engine 10. At low engine speeds and low load, the energy in the exhaust gases drives the turbocharger 70 at a low speed. As the engine is accelerated and/or the load increases, the energy in the exhaust gasses increases and the turbocharger 70 is continually driven at a higher speed until the engine reaches maximum RPM or load.

Repeatedly cycling the compressor 96 wheel between some low RPM's to full load conditions, like 100,000–150, 000 RPM's for an example, creates cyclic fatigue especially at the inner circumference 106. Cyclic fatigue tends to form cracks or further propagate existing cracks. Cold working or applying force sufficient to cause the inner circumference to plastically deform at temperatures below those needed for recrystallization creates residual compressive stresses that tend to eliminate or minimize surface defects present on the inner circumference. Further, these residual stresses tend to reduce propagation of any existing surface defects.

Other aspects, objects, and advantages of this invention can be obtained from a study of the drawings, the disclosure, and the appended claims.

What is claimed is:

1. A turbocharger for an internal combustion engine, having an axis comprising:

a shaft generally being coaxial with the axis, said shaft being rotable about a bearing;

a turbine being connected with said shaft, said turbine wheel being positioned in an exhaust housing; and a compressor wheel having a first end portion, a second end portion, and a hub portion, said first end portion being distal from said second end portion, said hub portion extending between said first end portion and said second end portion, said hub portion having an inner circumference defining a bore, said inner circumference being cold worked to reduce propagation of surface defects, said compressor wheel being connected to said shaft distal from said driving means.

2. The turbocharger as specified in claim 1 wherein said compressor wheel is made from a material selected from the group consisting of aluminum, titanium, steel, and alloys thereof.

3. The turbocharger as specified in claim 1 wherein said surface treatment is a roll burnish process.

4. The turbocharger as specified in claim 1 wherein said inner circumference is expanded a predetermined percentage by said cold working treatment.

5. A compressor wheel for a turbocharger, comprising:

a first end portion (100);

a hub portion (104) integral with said first end portion (100);

a second end portion (102) integral with said hub portion (104), said second end (102) portion being distal from said first end portion (100); and an inner circumference (106) of said hub portion (104) defining a bore extending between said first end portion (100) and said second end portion (102), said inner circumference (106) being cold worked.

6. The compressor wheel as specified in claim 1 wherein said cold working is by shot peening.

7. The compressor wheel as specified in claim 5 wherein said compressor wheel being made from a material from the group consisting of steel, aluminum, titanium, and alloys thereof.

* * * * *